US011760606B2

(12) United States Patent
Hu

(10) Patent No.: US 11,760,606 B2
(45) Date of Patent: Sep. 19, 2023

(54) GAP-REDUCING SILL ASSEMBLY FOR AN ELEVATOR CAR

(71) Applicant: OTIS ELEVATOR COMPANY, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 89 days.

(21) Appl. No.: 17/350,870

(22) Filed: Jun. 17, 2021

(65) Prior Publication Data

US 2021/0309492 A1 Oct. 7, 2021

Related U.S. Application Data

(62) Division of application No. 15/962,050, filed on Apr. 25, 2018, now Pat. No. 11,066,277.

(51) Int. Cl.

| | |
|---|---|
| ***B66B 13/28*** | (2006.01) |
| ***B66B 13/24*** | (2006.01) |
| ***B66B 13/30*** | (2006.01) |

(52) U.S. Cl.

CPC ..... *B66B 13/28* (2013.01); *B66B 13/245* (2013.01); *B66B 13/301* (2013.01)

(58) Field of Classification Search

CPC ..... B66B 13/245; B66B 13/28; B66B 13/301
See application file for complete search history.

(56) References Cited

U.S. PATENT DOCUMENTS

| | | | | |
|---|---|---|---|---|
| 2,120,081 A | | 6/1938 | Alexander | |
| 3,443,186 A | | 5/1969 | Martin | |
| 4,533,890 A | * | 8/1985 | Patel | H01F 7/1646 335/229 |
| 7,621,379 B2 | | 11/2009 | Miller et al. | |
| 2008/0128017 A1 | | 6/2008 | Ford | |
| 2009/0114486 A1 | * | 5/2009 | Ikonen | B66B 13/28 187/400 |

(Continued)

FOREIGN PATENT DOCUMENTS

| | | |
|---|---|---|
| CN | 202080797 U | 12/2011 |
| CN | 101948070 B | 7/2012 |

(Continued)

OTHER PUBLICATIONS

Mikko Nordlund, Development of Door Sill Assembly Test System, Metropolia University of Applied Sciences, Bachelor of Engineering, Mechanical Engineering and Production Technology, Bachelor's Thesis, Jun. 3, 2013, 76 pages.

(Continued)

*Primary Examiner* — Minh Truong

(74) *Attorney, Agent, or Firm* — Carlson, Gaskey & Olds, P.C.

(57) ABSTRACT

An illustrative example elevator sill assembly includes a sill plate and at least one support arm secured to the sill plate. A mounting bracket is configured to be mounted to an elevator car. The support arm is supported on the mounting bracket to allow the support arm to pivot relative to the mounting bracket. At least one linear actuator has a moving portion that moves in a vertical direction to cause the at least one support arm to pivot relative to the mounting bracket to thereby cause the sill plate to pivot from a stored position to an actuated position.

12 Claims, 4 Drawing Sheets

(56) References Cited

U.S. PATENT DOCUMENTS

| | | | |
|---|---|---|---|
| 2012/0164006 | A1 | 6/2012 | Moy et al. |
| 2018/0370770 | A1 | 12/2018 | Wakasa |
| 2019/0330027 | A1 | 10/2019 | Hu |

FOREIGN PATENT DOCUMENTS

| | | | | |
|---|---|---|---|---|
| CN | 102992151 | A | | 3/2013 |
| CN | 204897125 | U | | 12/2015 |
| CN | 205222328 | U | | 5/2016 |
| EP | 3418243 | A1 | | 12/2018 |
| JP | S60191983 | A | | 9/1985 |
| JP | H0543176 | B2 | | 6/1993 |
| JP | 2000016732 | A | | 1/2000 |
| JP | 2000118929 | A | * | 4/2000 |
| JP | 2000229773 | A | * | 8/2000 |
| JP | 2005082268 | A | | 3/2005 |
| JP | 4270627 | B2 | | 6/2009 |
| JP | 2009249116 | A | | 10/2009 |
| JP | 2009286504 | A | | 12/2009 |
| JP | 4507852 | B2 | | 7/2010 |
| JP | 2013180861 | A | | 9/2013 |
| JP | 6010401 | B2 | | 10/2016 |
| JP | 2017007840 | A | | 1/2017 |

OTHER PUBLICATIONS

Extended European Search Report for Application No. EP 19 17 0126 dated Sep. 26, 2019.
Extended European Search Report for Application No. EP 23 17 1181.3 dated Jun. 6, 2023.

* cited by examiner

GAP-REDUCING SILL ASSEMBLY FOR AN ELEVATOR CAR

CROSS REFERENCE TO RELATED APPLICATIONS

This application is a divisional of U.S. patent application Ser. No. 15/962,050 filed Apr. 25, 2018.

BACKGROUND

Elevators are in widespread use for carrying passengers and items among different levels in buildings, for example. When an elevator car is situated at a landing to allow passengers to enter or exit the car, a sill on the elevator car is aligned with a sill at the landing. Various aspects of elevator systems require some distance or spacing between the landing sill and the elevator car sill. That distance typically results in a gap that is wide enough for an object to fall through the gap and into the hoistway. For example, an individual dropping a key, coin, or credit card at the threshold to the elevator car might drop it through the gap between the sills. Additionally, some shoes include relatively thin, high heels that may at least partially slip into the gap, which is undesirable.

While various proposals have been made for reducing the gap between the elevator car sill and the landing sill or filling that gap when an elevator car is at the landing, none of them have been fully satisfactory.

SUMMARY

An illustrative example elevator sill assembly includes a sill plate and at least one support arm secured to the sill plate. A mounting bracket is configured to be mounted to an elevator car. The support arm is supported on the mounting bracket to allow the support arm to pivot relative to the mounting bracket. At least one linear actuator has a moving portion that moves in a vertical direction to cause the at least one support arm to pivot relative to the mounting bracket to thereby cause the sill plate to pivot from a stored position to an actuated position.

In an example embodiment having one or more features of the assembly of the previous paragraph, the at least one support arm is secured to the sill plate near one end of the at least one support arm, an opposite end of the at least one support arm includes a surface configured as a pinion, and the moving portion of the at least one linear actuator is configured as a rack that cooperates with the pinion to cause the at least one support arm to pivot as the rack moves relative to the mounting bracket.

In an example embodiment having one or more features of the assembly of any of the previous paragraphs, movement of the rack in a first direction causes movement of the sill plate into the actuated position and movement of the rack in a second direction causes movement of the sill plate into the stored position.

In an example embodiment having one or more features of the assembly of any of the previous paragraphs, the at least one support arm is secured to the sill plate near one end of the at least one support arm, an opposite end of the at least one support arm includes a contact surface, and the moving portion of the at least one linear actuator comprises a rod that contacts the contact surface to cause the at least one support arm to pivot to move the sill plate into the actuated position.

In an example embodiment having one or more features of the assembly of any of the previous paragraphs, the at least one support arm comprises a post near the opposite end of the at least one support arm and the contact surface is on the post.

In an example embodiment having one or more features of the assembly of any of the previous paragraphs, the mounting bracket comprises an arcuate slot, the post is received through the slot and the post follows the arcuate slot in response to contact with the moving portion of the linear actuator as the moving portion moves.

In an example embodiment having one or more features of the assembly of any of the previous paragraphs, the moving portion of the linear actuator comprises a shaft including an opening in the shaft, the at least one support arm is secured to the sill plate near one end of the at least one support arm, and an opposite end of the at least one support arm includes a post that is at least partially received in the opening in the shaft.

In an example embodiment having one or more features of the assembly of any of the previous paragraphs, the mounting bracket comprises an arcuate slot, the post is received through the slot, and the post follows the arcuate slot and moves with the moving portion of the linear actuator.

In an example embodiment having one or more features of the assembly of any of the previous paragraphs, the mounting bracket comprises guide surfaces that guide movement of the moving portion of the linear actuator.

In an example embodiment having one or more features of the assembly of any of the previous paragraphs, the linear actuator comprises a bi-stable solenoid.

An illustrative example elevator car assembly includes a cab, at least one door that is moveable to open or close an opening into the cab, a sill beneath the at least one door, a sill plate, at least one support arm secured to the sill plate, a mounting bracket configured to be mounted to an elevator car, the at least one support arm being supported on the mounting bracket to allow the at least one support arm to pivot relative to the mounting bracket, and at least one linear actuator having a moving portion that moves in a vertical direction to cause the at least one support arm to pivot relative to the mounting bracket to thereby cause the sill plate to pivot from a stored position at least partially beneath the sill to an actuated position where the sill plate is aligned with the sill.

In an example embodiment having one or more features of the assembly of any of the previous paragraphs, the at least one support arm is secured to the sill plate near one end of the at least one support arm, an opposite end of the at least one support arm includes a surface configured as a pinion, and the moving portion of the at least one linear actuator is configured as a rack that cooperates with the pinion to cause the at least one support arm to pivot as the rack moves relative to the mounting bracket.

In an example embodiment having one or more features of the assembly of any of the previous paragraphs, movement of the rack in a first direction causes movement of the sill plate into the actuated position and movement of the rack in a second direction causes movement of the sill plate into the stored position.

In an example embodiment having one or more features of the assembly of any of the previous paragraphs, the at least one support arm is secured to the sill plate near one end of the at least one support arm, an opposite end of the at least one support arm includes a contact surface, and the moving portion of the at least one linear actuator comprises a rod that contacts the contact surface to cause the at least one support arm to pivot to move the sill plate into the actuated position.

In an example embodiment having one or more features of the assembly of any of the previous paragraphs, the at least one support arm comprises a post near the opposite end of the at least one support arm and the contact surface is on the post.

In an example embodiment having one or more features of the assembly of any of the previous paragraphs, the mounting bracket comprises an arcuate slot, the post is received through the slot, and the post follows the arcuate slot in response to contact with the moving portion of the linear actuator as the moving portion moves.

In an example embodiment having one or more features of the assembly of any of the previous paragraphs, the moving portion of the linear actuator comprises a shaft including an opening in the shaft, the at least one support arm is secured to the sill plate near one end of the at least one support arm, and an opposite end of the at least one support arm includes a post that is at least partially received in the opening in the shaft.

In an example embodiment having one or more features of the assembly of any of the previous paragraphs, the mounting bracket comprises an arcuate slot, the post is received through the slot, and the post follows the arcuate slot and moves with the moving portion of the linear actuator.

In an example embodiment having one or more features of the assembly of any of the previous paragraphs, the mounting bracket comprises guide surfaces that guide movement of the moving portion of the linear actuator.

In an example embodiment having one or more features of the assembly of any of the previous paragraphs, the linear actuator comprises a bi-stable solenoid.

The various features and advantages of at least one example embodiment will become apparent to those skilled in the art from the following detailed description. The drawings that accompany the detailed description can be briefly described as follows.

DETAILED DESCRIPTION

Embodiments of this invention are useful for reducing the gap between the sills on an elevator car and a landing. A sill plate pivots from a stored position into an actuated positon where the sill plate at least partially blocks or covers the gap.

Figure 1:
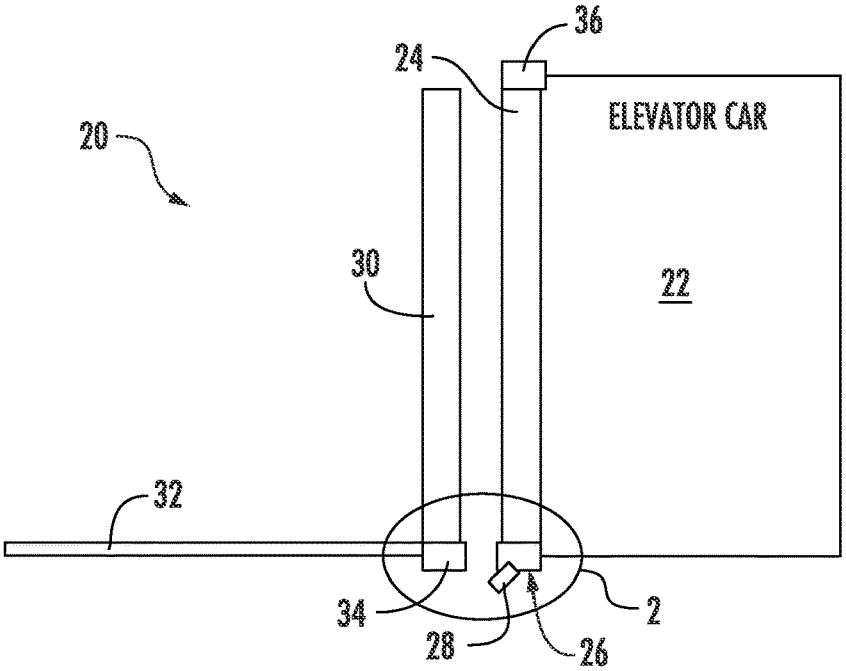
FIG. 1 schematically illustrates selected portions of an example elevator system including a sill assembly designed according to an embodiment of this invention with a sill plate in a stored position.

FIG. 1 schematically illustrates selected portions of an elevator system 20. An elevator car 22 includes at least one elevator car door 24 and a sill assembly 26 positioned beneath the elevator car door 24. The sill assembly 26 includes a sill plate 28 shown in a stored position in FIG. 1. At least one landing door 30 at a landing 32 moves relative to a landing sill 34 beneath the landing door 30. The elevator car door 24 and landing door 34 move together using known coupling techniques.

As shown in FIG. 1, a controller 36 controls operation of the sill assembly 26 based on the position of the elevator car door 24. In one example embodiment, the controller 36 is a dedicated sill assembly controller that communicates with a separate elevator door controller that controls the door position. In another embodiment, the controller 36 is the same controller as that which controls movement of the elevator car door 24. In such embodiments, an additional software or firmware module is provided to the door controller for purposes of controlling the sill assembly 26 in a coordinated manner.

Figure 2:
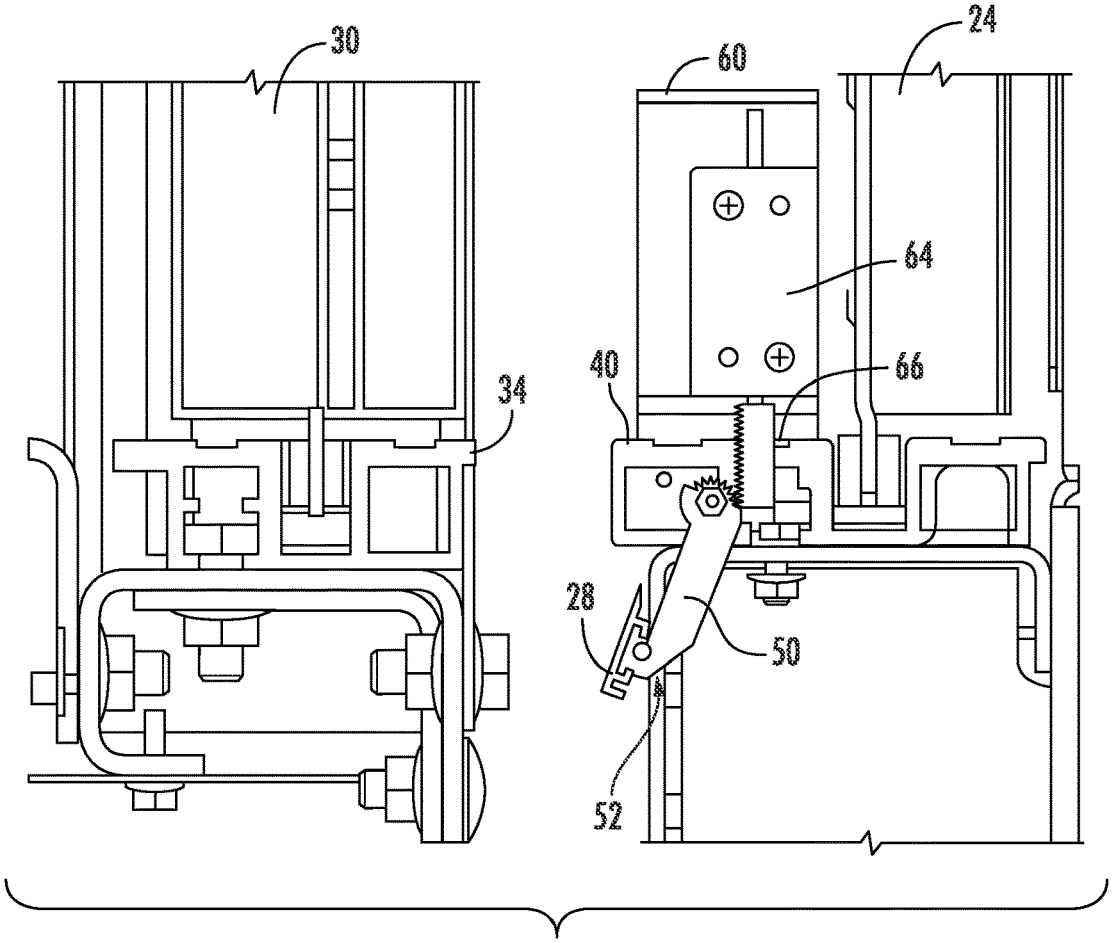
FIG. 2 illustrates, in somewhat more detail, the portion of FIG. 1 encircled at 2.
Figure 3:
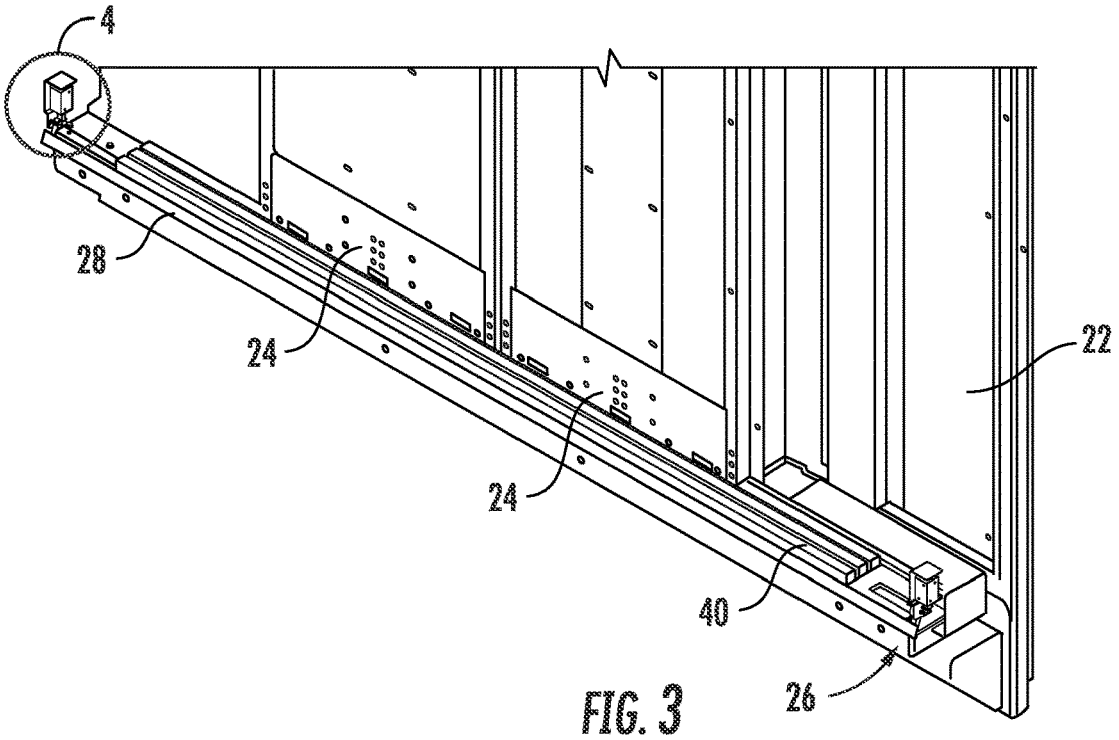
FIG. 3 illustrates selected portions of the elevator car of FIG. 1 and the sill assembly with a sill plate in a stored position.
Figure 4:
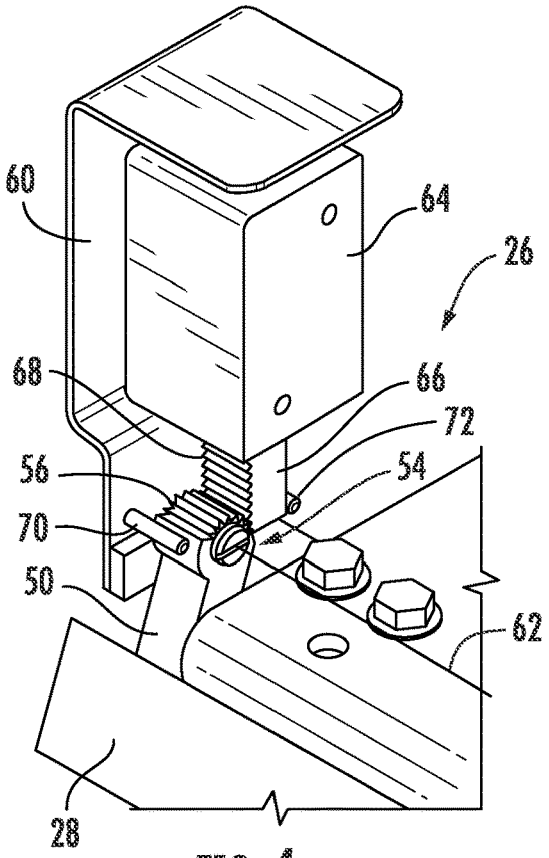
FIG. 4 illustrates the components encircled at 4 in FIG. 3.

FIGS. 3 and 4 show elevator car doors 24 in a closed position and the sill plate 28 in a stored position where the sill plate 28 is transverse to the elevator car sill 40. As best appreciated from FIG. 4, the sill assembly 26 includes a support arm 50 secured to the sill plate 28. As shown in FIG. 2, for example, one end 52 of the support arm 50 includes a connector for securing the support arm 50 to the sill plate 28. In the illustrated example, the connector fits within a groove or channel on the sill plate 28.

An opposite end 54 of the support arm 50 is configured as a pinion and includes a plurality of teeth or ridges 56.

A mounting bracket 60 is configured to be secured to the elevator car 22. The mounting bracket 60 supports the support arm 50 so that the support arm 50 can pivot about a pivot axis 62, which is parallel to the elevator car sill 40 in this example. The sill plate pivots about the pivot axis 62 as it moves between the stored and activated positions.

The mounting bracket 60 also supports a linear actuator 64. A moving portion 66 of the linear actuator 64 moves vertically relative to the mounting bracket 60. The moving portion 66 is configured as a rack in this embodiment and includes a plurality of teeth or ridges 68 that cooperate with the teeth or ridges 66 on the pinion portion of the support arm 50.

In some embodiments, the linear actuator 64 comprises a bi-stable solenoid that holds the moving portion 66 in a fixed position when the solenoid is not powered. Bi-stable solenoids are capable of holding the sill plate 28 in the stored position during elevator car movement.

Figure 7:
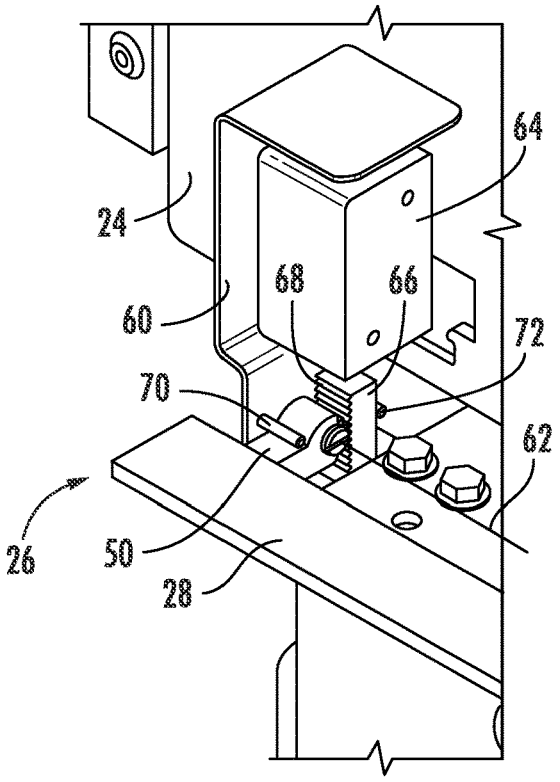
FIG. 7 illustrates the components shown in FIG. 4 with the sill plate in the actuated position.
Figure 5:
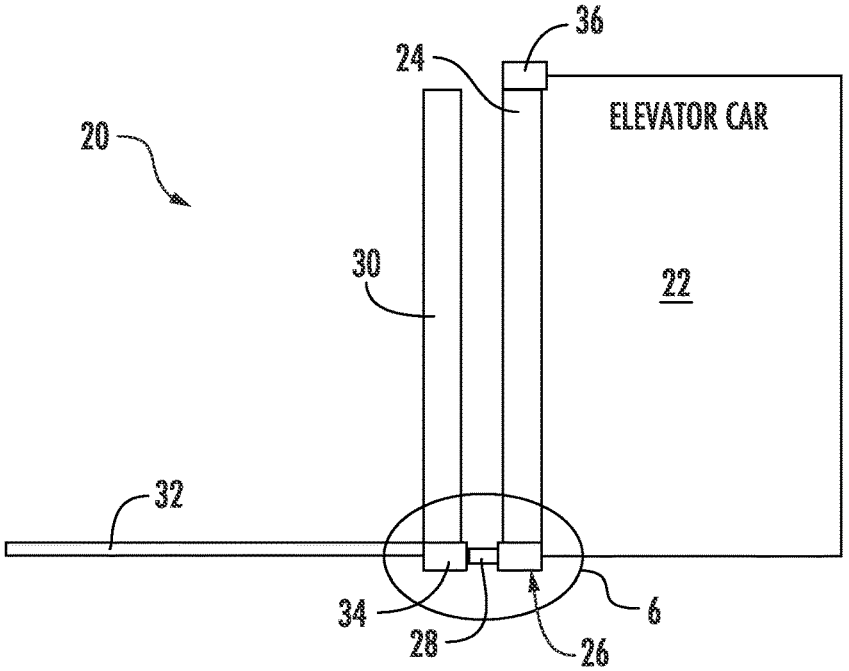
FIG. 5 is an illustration corresponding to FIG. 1 with the sill plate of the sill assembly in an actuated position.
Figure 6:
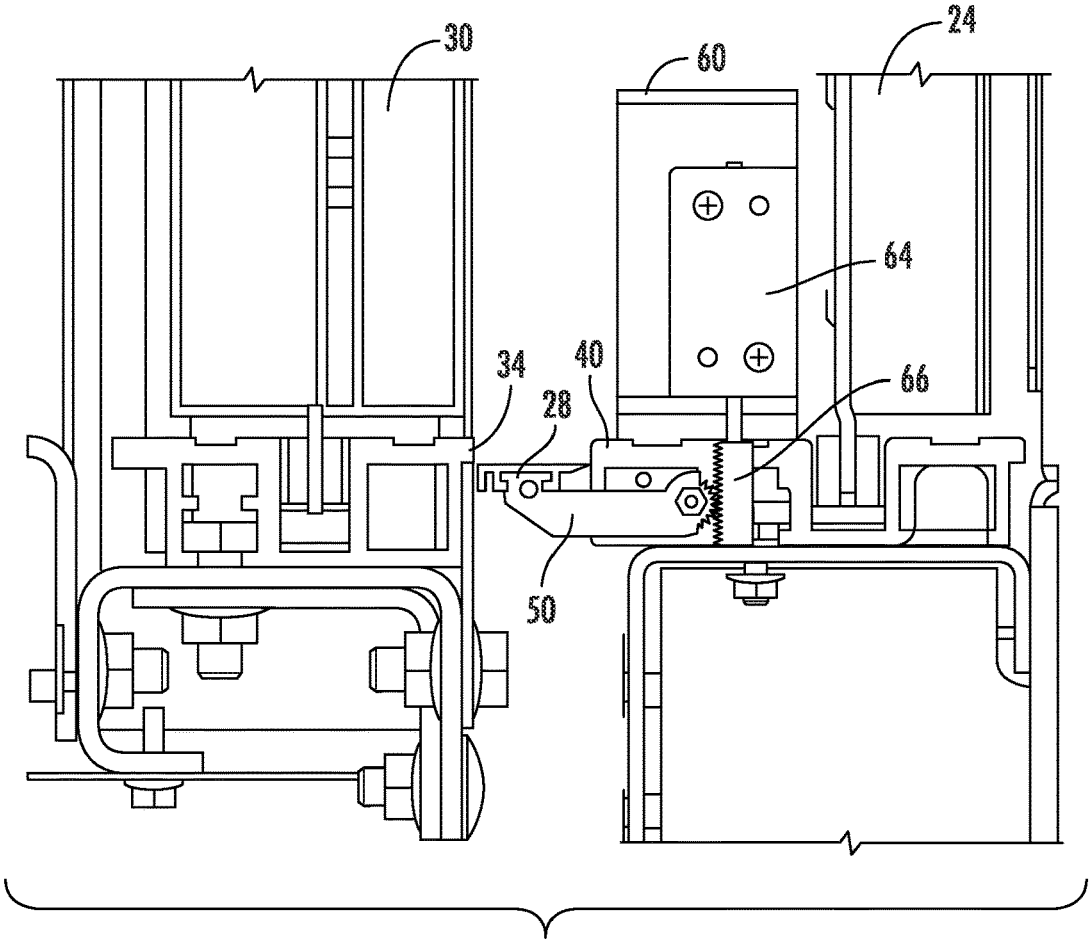
FIG. 6 illustrates, in somewhat more detail, the components encircled at 6 in FIG. 5.

As shown in FIGS. 5-7, the elevator car doors 24 move into an open position and the sill plate 28 moves into an actuated position where the sill plate 28 is aligned with the elevator car sill 40. The linear actuator 64 causes downward movement of the moving portion 66 as the elevator car doors 24 approach a fully opened position. The vertical movement of the moving portion 66 causes pivotal movement of the support arm 50 about the axis 62 causing the sill plate 28 to pivot from the stored position (e.g., illustrated in FIG. 4) to the actuated position (e.g., illustrated in FIG. 7).

In embodiments that include a bi-stable solenoid as the linear actuator 64, the solenoid holds the sill plate 28 in the actuated position as long as desired without requiring power to maintain that position. Other embodiments include a conventional linear solenoid with a spring that biases the solenoid in a direction that leaves the sill plate 28 in the stored position. When powered, the solenoid acts against the spring and holds the sill plate 28 in the actuated position.

The illustrated example includes a stop member 70 in the form of a pin or rod supported on the mounting bracket 60. The stop member 70 limits an amount of movement of the support arm 50 to control the position of the sill plate 28 in the actuated position.

A guide pin 72 is provided on the mounting bracket 60 to ensure appropriate engagement between the teeth or ridges 68 on the moving member 66 and the teeth or ridges 56 on the pinion portion of the support arm 50.

As the elevator car doors 24 move back toward a closed position, the linear actuator 64 causes movement of the moving member 66 in an upward direction (according to the drawings) to return the sill plate 28 to the stored position.

Figure 8:
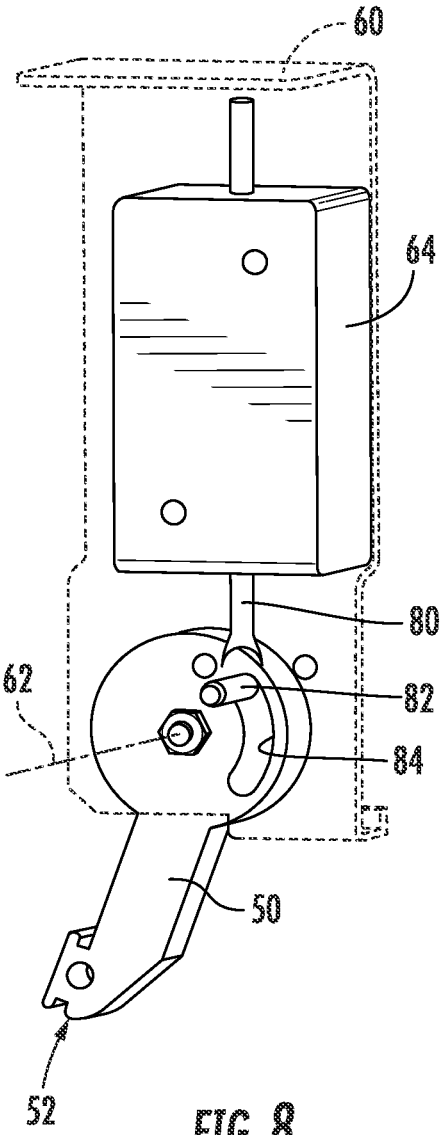
FIG. 8 illustrates selected portions of another example embodiment.

Another example embodiment is shown in FIG. 8. In this example, the linear actuator 64 includes a rod 80 as the moving member that moves vertically for purposes of causing pivotal movement of the support arm 50. A post 82 extending from the support arm 50 provides a contact surface that the rod 80 contacts to cause movement of the support arm 50 to bring the sill plate 28 into the actuated position. The rod 80 moves downward to accomplish this in the illustrated example.

The mounting bracket includes an arcuate slot 84 that the post 82 follows during pivotal movement of the support arm 50 about the pivot axis 62.

In embodiments that include a bi-stable solenoid as the linear actuator 64, the rod 80 holds the post 82 in a position near the bottom (according to the drawing) of the slot 84 to maintain the sill plate 28 in the actuated position. When the rod 80 moves vertically upward (according to the drawing), the mass of the sill plate 28 and gravity pull the sill plate 28 back toward the stored position because the rod 80 is not resisting upward movement (according to the drawing) of the post 82.

Figure 9:
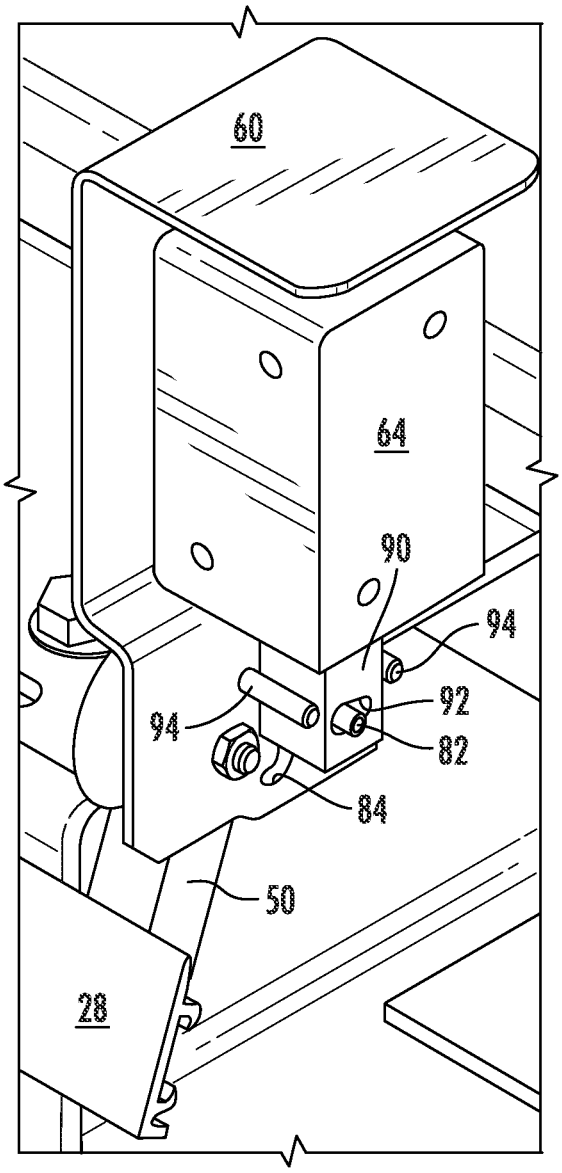
FIG. 9 illustrates selected portions of another example embodiment.

FIG. 9 illustrates another example embodiment in which the linear actuator 64 includes a moveable shaft 90 that moves vertically. The shaft 90 includes an opening 92, which extends fully through the shaft 90 in the illustrated example. The post 82 extending from the support arm 50 is received within the opening 92. As the shaft 90 moves vertically, the post 82 follows along the arcuate slot 84 in the mounting bracket 60. Downward movement of the shaft 90 (according to the drawing) causes pivotal movement of the support arm 50 to bring the sill plate 28 from the stored position into the actuated position. A bi-stable solenoid linear actuator 64 is capable of holding the sill plate 28 in the actuated position without requiring power. When the elevator car doors 24 return to a closed position, the linear actuator 64 moves the shaft 90 in a direction to cause movement of the sill plate 28 back to the stored position, which is illustrated in FIG. 9. A bi-stable solenoid will hold the sill plate 28 in the stored position without requiring power.

The example of FIG. 9 includes guideposts 94 on the mounting bracket 60 that guide movement of the shaft 90.

Embodiments of this invention improve the aesthetics of an elevator system by reducing a visible gap between the elevator car sill and the landing sill. In the actuated position, the sill plate 28 reduces the possibility of elevator passengers inadvertently dropping small items into the hoistway. The illustrated example embodiments can be used in elevator systems that include advance door opening techniques without interfering with the efficiencies provided by such techniques. The design of the components of the illustrated examples reduces the number of parts that have to be maintained in inventory and facilitates easier assembly.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator sill assembly, comprising:

a sill plate;

at least one support arm secured to the sill plate;

a mounting bracket configured to be mounted to an elevator car, the at least one support arm being supported on the mounting bracket to allow the at least one support arm to pivot relative to the mounting bracket; and at least one linear actuator having a moving portion that moves in a vertical direction to cause the at least one support arm to pivot relative to the mounting bracket to thereby cause the sill plate to pivot from a stored position to an actuated position, wherein:

the moving portion of the at least one linear actuator comprises a shaft including an opening in the shaft, the at least one support arm is secured to the sill plate near one end of the at least one support arm, an opposite end of the at least one support arm includes a post that is at least partially received in the opening in the shaft, the mounting bracket comprises an arcuate slot, the post is received through the arcuate slot, and the post follows the arcuate slot and moves with the moving portion of the at least one linear actuator.

2. The assembly of claim 1, wherein the post follows the arcuate slot in response to contact with the moving portion of the at least one linear actuator as the moving portion moves.

3. The assembly of claim 1, wherein the mounting bracket comprises guide surfaces that guide movement of the moving portion of the at least one linear actuator.

4. The assembly of claim 1, wherein the at least one linear actuator comprises a bi-stable solenoid.

5. An elevator car assembly, comprising:

a cab;

at least one door that is moveable to open or close an opening into the cab;

a sill beneath the at least one door;

a sill plate;

at least one support arm secured to the sill plate;

a mounting bracket configured to be mounted to an elevator car, the at least one support arm being supported on the mounting bracket to allow the at least one support arm to pivot relative to the mounting bracket; and at least one linear actuator having a moving portion that moves in a vertical direction to cause the at least one support arm to pivot relative to the mounting bracket to thereby cause the sill plate to pivot from a stored position at least partially beneath the sill to an actuated position where the sill plate is aligned with the sill, wherein:

the moving portion of the at least one linear actuator comprises a shaft including an opening in the shaft, the at least one support arm is secured to the sill plate near one end of the at least one support arm, an opposite end of the at least one support arm includes a post that is at least partially received in the opening in the shaft, the mounting bracket comprises an arcuate slot, the post is received through the arcuate slot, and the post follows the arcuate slot and moves with the moving portion of the at least one linear actuator.

6. The assembly of claim 5, wherein the post follows the arcuate slot in response to contact with the moving portion of the at least one linear actuator as the moving portion moves.

7. The assembly of claim 5, wherein the mounting bracket comprises guide surfaces that guide movement of the moving portion of the at least one linear actuator.

8. The assembly of claim 5, wherein the at least one linear actuator comprises a bi-stable solenoid.

9. An elevator sill assembly, comprising:

a sill plate;

at least one support arm secured to the sill plate;

a mounting bracket configured to be mounted to an elevator car, the at least one support arm being supported on the mounting bracket to allow the at least one support arm to pivot relative to the mounting bracket, and wherein the mounting bracket includes at least one bracket opening; and at least one linear actuator having a moving portion that moves in a vertical direction to cause the at least one support arm to pivot relative to the mounting bracket to thereby cause the sill plate to pivot from a stored position to an actuated position, wherein:

the moving portion of the at least one linear actuator comprises a shaft including a shaft opening in the shaft that is at least partially aligned with the at least one bracket opening, the at least one support arm is secured to the sill plate near one end of the at least one support arm, an opposite end of the at least one support arm includes a post that remains in a fixed position relative to the at least one support arm, and the post extends through the at least one bracket opening and is at least partially received in the shaft opening in the shaft, and wherein the post follows a path defined by the at least one bracket opening in response to contact with the moving portion of the at least one linear actuator as the moving portion moves.

10. The assembly of claim 9, wherein the at least one bracket opening in the mounting bracket comprises an arcuate slot;

the post is received through the arcuate slot; and the post follows the arcuate slot in response to contact with the moving portion of the at least one linear actuator as the moving portion moves.

11. The assembly of claim 9, wherein the mounting bracket comprises guide surfaces that guide movement of the moving portion of the at least one linear actuator.

12. The assembly of claim 9, wherein the at least one linear actuator comprises a bi-stable solenoid.

* * * * *